US005749125A

United States Patent [19]

Davis et al.

[11] Patent Number: 5,749,125

[45] Date of Patent: May 12, 1998

[54] HINGE BRACKET FOR A CABINET DOOR

[75] Inventors: Keith L. Davis, Wapello; Kirk A. Petersen, Muscatine, both of Iowa

[73] Assignee: Hon Industries Inc., Muscatine, Iowa

[21] Appl. No.: 685,717

[22] Filed: Jul. 24, 1996

[51] Int. Cl.[6] ..... E05D 5/00

[52] U.S. Cl. ..... 16/382; 16/DIG. 43; 312/334.1; 312/323; 312/110

[58] Field of Search ..... 16/382, 374, DIG. 40, 16/DIG. 43, 90, 91, 96 R; 312/334.1, 334.7, 322, 323, 332, 109, 110, 139.1, 139.2

[56] References Cited

U.S. PATENT DOCUMENTS 4,600,254 7/1986 Whalen ..... 312/323
4,615,570 10/1986 Goodman ..... 312/110
4,925,258 5/1990 Ludwig et al. ..... 312/323
5,399,010 3/1995 McClung et al. ..... 312/334

*Primary Examiner*—Chuck Y. Mah
*Attorney, Agent, or Firm*—Jones, Day, Reavis & Pogue

[57] ABSTRACT

A hinge bracket assembly for a flipper door comprises a bracket body to which a pair of spaced rollers are fitted along an edge thereof. The rollers are spaced slightly from a flange portion of the bracket body to define slots therebetween. A hinge arrangement is provided along a forward edge of the bracket body for hingeable attachment to a cabinet door. The bracket flange portion is slideable within a simple J-channel mounted to an inside wall of the cabinet whereby the rollers bear against a flange surface of the J-channel and serve to inhibit rotational movement of the bracket body relative to the J-channel as the body is guided lengthwise of the channel. A pair of such brackets each mounted to opposite sides of the door thereby allows the door to freely retract into the cabinet without racking.

10 Claims, 4 Drawing Sheets

HINGE BRACKET FOR A CABINET DOOR

BACKGROUND OF THE INVENTION

1. Field of the Invention

The present invention relates generally to a hinge bracket assembly for a cabinet door and, more particularly, to a novel and inexpensive means for mounting a cabinet door of a type known as a flipper door wherein the door does not rack when moved to a retracted position within the cabinet.

2. Description of the Prior Art

Many types of cabinets are known for storing printed matter or other articles. A form of cabinet is known, for example, as a lateral file cabinet which has widespread use in office environments. A lateral file cabinet typically includes a file case having drawers mounted on slides as to be movable into and out of the case. The cabinet is often provided with doors which pivot open about an upper hinge arrangement and retract back into the case to allow access to the drawer contents. This type of door arrangement has come to be known as a flipper or rollup door.

A problem which can be encountered with flipper doors is that as the door is moved to a retracted position within the cabinet, racking or binding of the door can occur if the door sides do not move evenly at the same rate while sliding back into the cabinet. Such racking can cause an annoying jamming of the door requiring undesirable manual realignment of the door to move it to a retracted position. To minimize door racking it is known to use a rack and pinion door mounting system which essentially constrains the door sides to movement at the same rate of speed. These arrangements typically include racks mounted on opposite sides of the inside walls of the cabinet which cooperate with a pair of interconnected pinion gears mounted along the door upper edge. Examples of such arrangements are disclosed in U.S. Pat. Nos. 4,600,254 issued to Whalen, 4,615,570 issued to Goodman and 5,399,010 issued to McClung et al.

A disadvantage of known rack and pinion arrangements for mounting flipper doors is that these structures typically include expensive components which are not easily assembled. Accordingly, they are confined to use on relatively high end, expensive cabinet products. It is therefore desirable to provide a flipper door mounting arrangement which reliably minimizes racking of the door but which involves relatively few structural components. It is further desirable to provide such a mounting arrangement which can be assembled with relative ease whereby an associated cabinet can be constructed with resulting economies.

SUMMARY OF THE INVENTION

The present invention improves over the prior art by providing a hinge bracket assembly for a flipper door comprising a bracket body to which a pair of spaced rollers are fitted along an edge thereof. The rollers are spaced slightly from a flange portion of the bracket body to define slots therebetween. A hinge arrangement is provided along a forward edge of the bracket body for hingeable attachment to a cabinet door. The bracket flange portion is slideable within a simple J-channel mounted to an inside wall of the cabinet whereby the rollers bear against a flange surface of the J-channel and serve to inhibit rotational movement of the bracket body relative to the J-channel as the body is guided lengthwise of the channel. A pair of such brackets each mounted to opposite sides of the door thereby allows the door to freely retract into the cabinet without racking. The hinges include simple metal hinge plates attached to the door and connected to the two brackets by removable pins which are designed to snap into locked position. The hinge bracket can thereby be easily installed with minimal manual labor.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
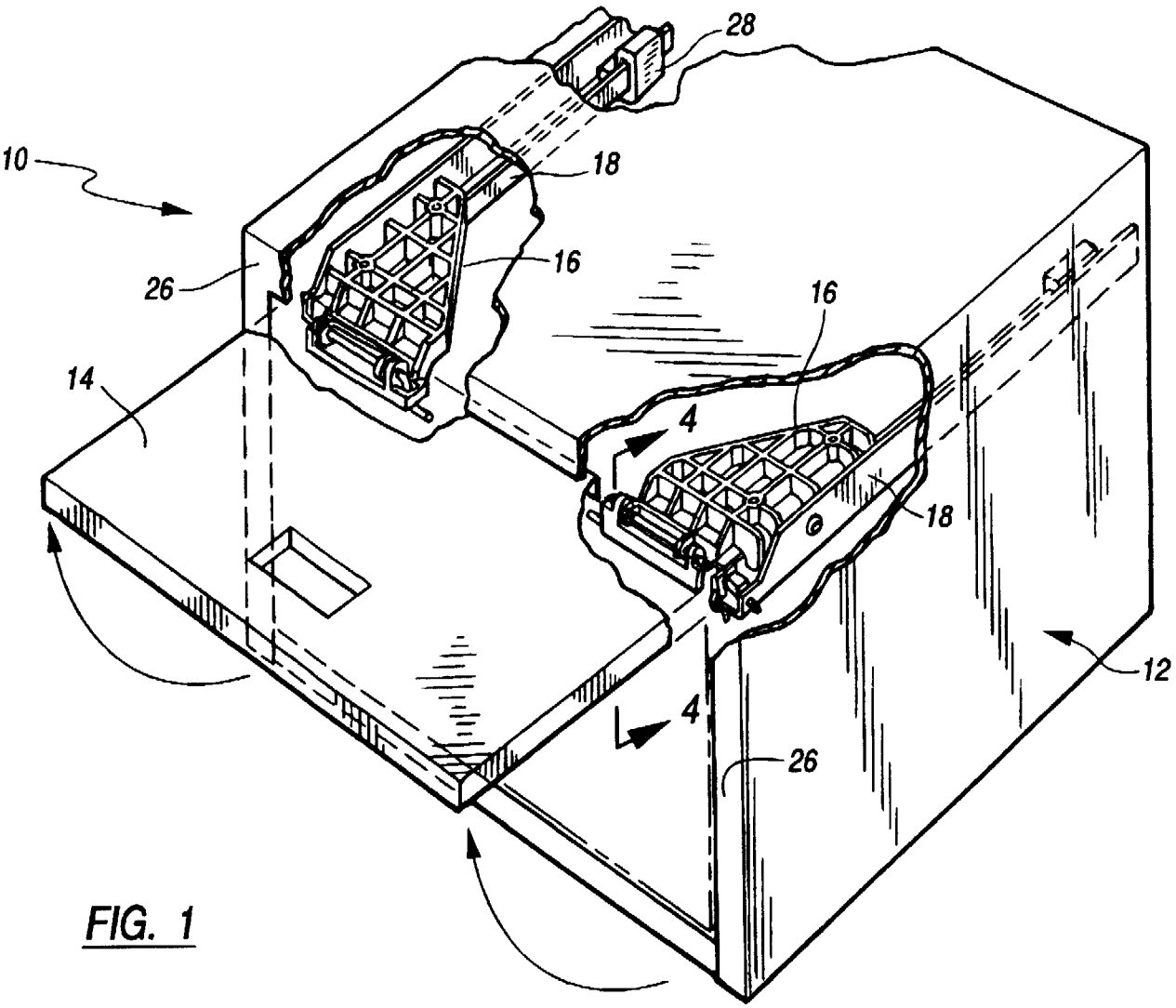
FIG. 1. is a perspective view of a cabinet partially broken away illustrating a cabinet door in an open but unretracted position.
Figures 2, 3, 4:
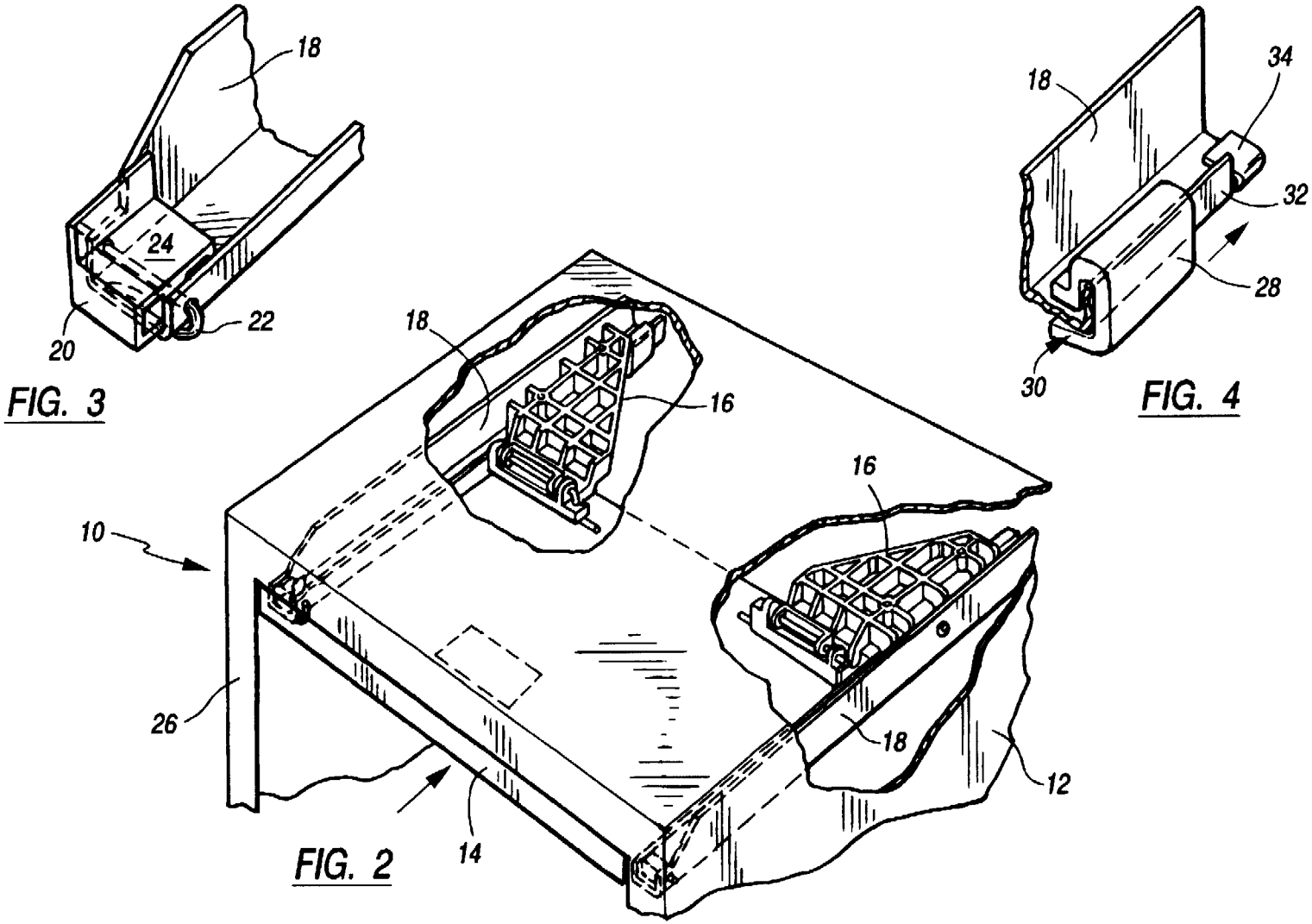
FIG. 2. is a partial perspective view of the cabinet partially broken away illustrating the cabinet door in a fully retracted position.
FIG. 3. is a partial perspective view of J-channel slide member illustrating a forward stop.
FIG. 4. is a partial perspective view of the J-channel slide member illustrating a rear stop.

Referring now to the drawings and initially to FIG. 1, a cabinet assembly is designated generally by the reference numeral 10 and includes an enclosure 12 with a pivotable door 14. In this view the door 14 is shown open but in an unretracted position. Supporting the door 14 are a pair of spaced hinge brackets 16 which slide in respective J-channels 18 mounted to inside walls of the cabinet enclosure 12. The J-channels 18 may in one form of the invention be fastened to suitable vertically extending rails (not shown) which, in turn, are welded to the sides of the enclosure 12 as to provide the exterior of the enclosure 12 with a smooth finished appearance by concealing any mechanical fasteners. FIG. 2 illustrates the door 14 in a fully retracted position within the enclosure 12. In this position, the brackets 16 have slid in the J-channels 18 to the rear of the cabinet enclosure 12.

Turning now to FIG. 3, a forward portion of the J-channel 18 is illustrated showing a forward stop pad 20 fastened to the J-channel by a clip 22. The stop pad 20 which may be molded of suitable plastic material, serves to stop the hinge bracket 16 from advancing too far forward to disengage from the J-channel 18. The upper surface 24 of the stop 20 and inside of top flange of stop 20 also serves as a bearing surface for the edges of the door 14 as the door 14 retracts into the cabinet enclosure 12. When the brackets 16 are in abutment with respective stop pads 20, the door is pivotable to a closed vertical position wherein it is flush with edge faces 26 of the enclosure 12. In FIG. 4, a rear portion of the J-channel 18 is illustrated showing a rear stop pad 28 having an L-shaped slot 30 cooperating with flange portion 32 of the J-channel 18. A tab 34 is bent from the portion 32 and serves to limit rearward movement of the stop 28. The stop 28 thereby serves to, in turn, limit extreme rearward movement of hinge bracket 16.

Figure 5:
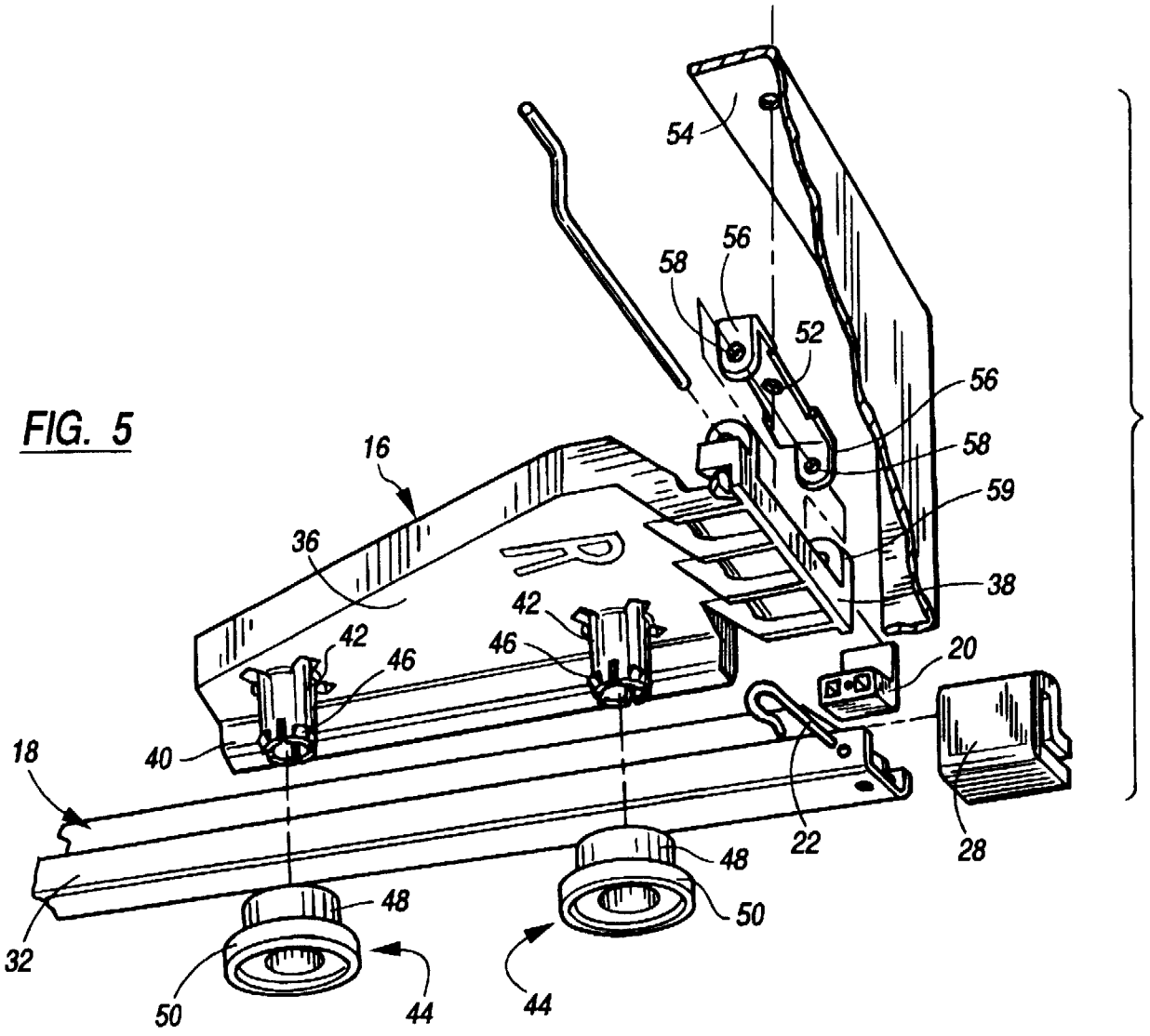
FIG. 5. is an exploded perspective view of a hinge bracket assembly constructed in accordance with the invention.

Details of the hinge bracket 16 can best be seen in FIG. 5. The bracket 16 is preferably injection molded from a suitable plastic material and includes a generally plate-like body portion 36 and an integrally formed hinge portion 38. The body portion 36 has one edge defining a downwardly projecting flange portion 40 which is dimensioned and configured to fit in and slide along the J-channel 18. The body portion 36 is also formed with a pair of spaced, downwardly projecting journals 42 onto which rollers 44 are fitted. The journals 42 are provided with teeth 46 such that the rollers 44 may be snapped onto and retained for rotational movement by the journals 42. Each roller 44 has a small diameter roller surface 48 and a large diameter roller portion 50, the purpose of which will be described hereinafter. Mounting of the door 14 to the hinge bracket 16 is accomplished using a metal hinge plate 52 which may be attached to an upper flange 54 of the door 14. The hinge plate 52 has a pair of right angle bent ears 56 each provided with an aperture 58. The plate 52 is so dimensioned such that the ears 56 may be aligned with ears 59 formed on the hinge portion 38 of the bracket 16, whereby a metal pin 60 may be inserted through the ears 56 and 59 to form a hingeable connection.

Figure 7:
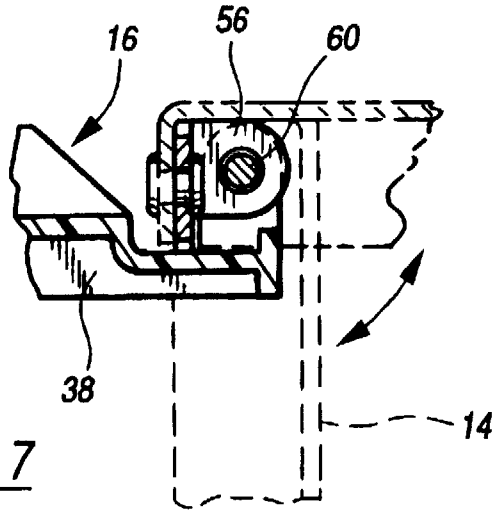
FIG. 7. is a cross-sectional view taken substantially along the line 7—7 of FIG.6.
Figure 6:
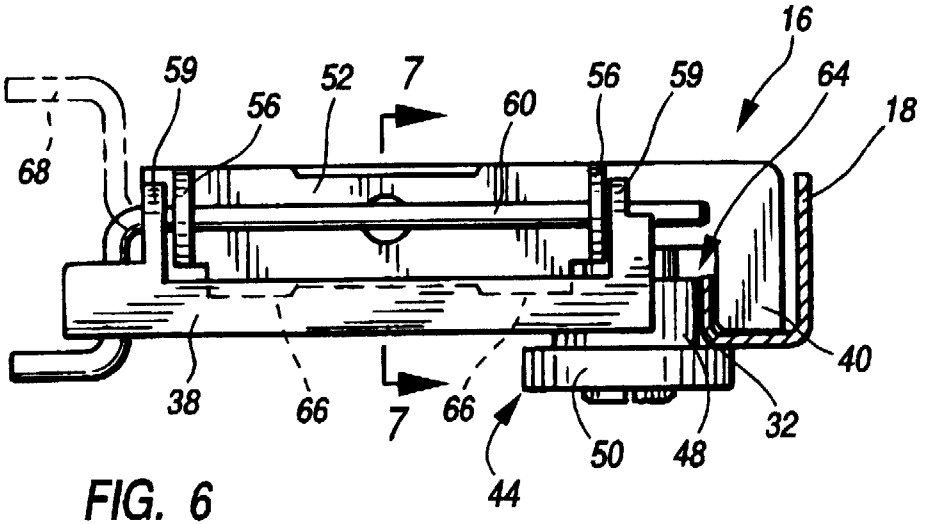
FIG. 6. is a front elevational view illustrating the hinge bracket as installed in a J-channel.

Referring now to FIGS. 6 and 7, the bracket 16 is illustrated with flange portion 40 of the body 36 seated in the J-channel 18. In this position, the portion 40 may freely slide on the J-channel. As also seen, the roller surfaces 48 are closely spaced from the flange portion 40 defining slots 64 through which flange portion 32 of J-channel 18 passes. The roller surfaces 48 may thereby roll on the J-channel. The large diameter roller portions 50 extend beneath the J-channels 18, thereby the brackets 16 are securely fixed to the J-channels 18 except for sliding movement lengthwise of the J-channels 18. An important feature of the hinge plates 52 is that they are formed with tabs 66 which abut the hinge portion 38 and limit pivotable movement of the door 14 such that during opening the door 14 can pivot upwardly through only ninety degrees or to a horizontal disposition. This assures that the door 14 will be in proper position to be retracted into the cabinet enclosure 12.

Figure 8:
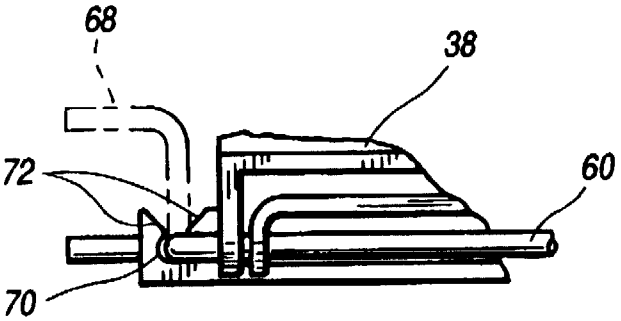
FIG. 8. is a partial top plan view of a hinge portion of the bracket illustrating the locking arrangement of a hinge pin.

FIG. 8 best illustrates another feature of the invention relating to the assembly of the hinge pin 60. The pin 60 is preferably formed with an offset end portion 68. Moreover, the hinge portion 38 of the bracket 16 is provided with a slot 70 having latch members 72. Thus, once the pin 60 is installed through the ears 56 and 59 to create the hinge connection with the door 14, the offset portion 68 of the pin 60 may be rotated and manually forced into the slot 70 and retained therein by the latch members 72.

It can now be appreciated that hinge bracket system in accordance with the invention provides an inexpensive yet highly effective means for supporting a cabinet flipper door in a manner preventing racking as the door is retracted into the cabinet. The body 36 of the hinge bracket 16 is readily moldable as a simple plastic component. The snap fit of the rollers 44 to the journals 42 of the brackets 16 provides for ease of assembly of the brackets 16. Moreover, the hinge construction with latching hinge pin 60 feature allows for ease of both assembly and disassembly of the door 14.

While the present invention has been described in connection with preferred embodiments thereof, it will be apparent to those skilled in the art that many changes and modifications may be made without departing from the true spirit and scope of the invention. Accordingly, it is intended by the appended claims to cover all such changes and modifications as come within the spirit and scope of the invention.

What is claimed is:

1. A hinge bracket assembly for a cabinet door comprising:

a bracket body having top and bottom sides and a lengthwise edge;

a flange portion extending at right angles to said bottom side and disposed along said edge;

a pair of spaced rollers along said edge closely spaced from said flange portion defining slots between said rollers and said flange portion;

hinge means configured along a forward edge of said body for attachment to a cabinet door;

wherein said bracket flange portion is insertable into and is slidable lengthwise of a generally elongate channel member, said channel member having an upstanding flange portion receivable in said slots such that said rollers can bear on said channel flange portion and serve to inhibit rotational movement of said bracket body relative to said channel as said body is guided lengthwise of said channel.

2. The assembly of claim 1 wherein said hinge means is connectable to a hinge plate and said hinge plate is attachable to a cabinet door.

3. The assembly of claim 2 wherein said hinge means and hinge plate are connectable by a pin.

4. The assembly of claim 3 wherein said hinge means includes a latch and said pin is received and retained by said latch.

5. The assembly of claim 2 wherein said hinge means includes stop means for limiting hingeable movement of said hinge plate.

6. The assembly of claim 1 wherein said rollers include an enlarged diameter roller portion for engaging an underside surface of said channel member thereby retaining said bracket assembly in mounted position on said channel member.

7. A system for hingeably securing a door to a cabinet enclosure such that the door is retractable within the enclosure, the system comprising:

a pair of generally J-shaped channel members attachable to opposed inside walls of a cabinet enclosure with channel recesses opening upwardly within said enclosure;

a pair of hinge bracket assemblies each having a generally plate-like body portion with a lengthwise edge having a downwardly directed flange portion defined along said edge;

a pair of spaced rollers journalled for rotation on said body portion and having roller surfaces closely spaced from said flange portion to define slots there between;

forwardly directed hinge portions of said hinge brackets each cooperating with a hinge plate and said hinge plate is attachable to a cabinet door;

wherein said rollers ride on surfaces of said channel members when said flange portions of said body members are positioned within respective channel recesses and said rollers serve to inhibit rotational movement of said bracket assemblies relative to said channel members whereby said door can be retracted into said cabinet enclosure without racking.

8. The system of claim 7 wherein said rollers include first roller surfaces which ride on respective flange portions of said channel members and have enlarged diameter second roller portions which are disposed beneath said channel members to prevent said bracket assemblies from disassociating from said channel members.

9. The system of claim 7 wherein the hinge portions of said hinge brackets are connected to said hinge plates by pins.

10. The system of claim 9 wherein said hinge portions of said hinge brackets include latch portions for fixedly latching said pins to said hinge brackets.

* * * * *